United States Patent [19]

Mayer

[11] 4,341,147

[45] Jul. 27, 1982

[54] COAXIAL DUAL HOLLOW PISTON REGENERATIVE LIQUID PROPELLANT GUN

[75] Inventor: Robert E. Mayer, Williamstown, Mass.

[73] Assignee: General Electric Company, Schenectady, N.Y.

[21] Appl. No.: 158,939

[22] Filed: Jun. 16, 1980

[51] Int. Cl.[3] ..... F41F 1/04

[52] U.S. Cl. ..... 89/7

[58] Field of Search ..... 89/7, 8, 11, 1 R

[56] References Cited

U.S. PATENT DOCUMENTS

| | | | |
|---|---|---|---|
| 3,138,990 | 10/1961 | Jukes et al. | 89/7 |
| 3,160,064 | 12/1964 | Bell et al. | 89/155 |
| 4,023,463 | 5/1977 | Tassie | 89/7 |
| 4,033,224 | 7/1977 | Holtrop | 89/7 |
| 4,050,349 | 9/1977 | Graham | 89/7 |
| 4,063,486 | 12/1977 | Ashley | 89/7 |
| 4,099,445 | 7/1978 | Singelmann et al. | 89/7 |
| 4,100,836 | 7/1978 | Hofmann | 89/7 |
| 4,269,107 | 5/1981 | Campbell | 89/7 |
| 4,281,582 | 8/1981 | Jagua | 89/7 |

*Primary Examiner*—David H. Brown

*Attorney, Agent, or Firm*—Francis K. Richwine

[57] ABSTRACT

A regenerative liquid propellant gun having structure which reacts to combustion pressure to dispense and regulate the flow of liquid propellant from an included reservoir as one parameter for obtaining a predetermined pressure/time curve of gun chamber pressure. A first coaxial pumping piston is a differential area pressure piston operating between the combustion chamber and the primary propellant reservoir. A second coaxial piston in a bore in the first piston opens and closes injection ducts running through the pumping piston from the primary reservoir to the bore to interdict flow of propellant to the combustion chamber as a result of relative motion of the two pistons as one or both move responsive to propellant combustion pressure. The second piston may also be a differential area piston operating between the combustion chamber and a second reservoir which may also dispense propellant to the combustion chamber or may be a part of a separate hydraulic system dedicated to hydraulic control of the second piston. The disclosure includes several alternative arrangements for control of the relative movement between the pistons.

32 Claims, 7 Drawing Figures

COAXIAL DUAL HOLLOW PISTON REGENERATIVE LIQUID PROPELLANT GUN

RELATED APPLICATIONS

This application is related to co-pending U.S. patent applications Ser. Nos. 840,074; 840,075; and 840,104; filed Oct. 6, 1977.

BACKGROUND OF THE INVENTION

1. Field of the Invention

This invention relates to liquid propellant guns utilizing differential area pistons to provide continued or regenerative injection of a liquid propellant into the combustion chamber and, particularly, to such guns in which there are a plurality of coaxial pistons arranged so as to provide for relative piston action as a means for controlling propellant injection and, particularly, in configurations permitting the insertion of a projectile through the breech structure of the gun.

2. Description of the Prior Art

An extensive summary of the prior art appears in the patent application of R. E. Mayer, Ser. No. 840,104 filed Oct. 6, 1977, and companion applications Bulman Ser. No. 840,074 and Algera Ser. No. 840,075 also filed Oct. 6, 1977. The patents to R. A. Jukes et al, U.S. Pat. No. 3,138,990, June 30, 1964; D. P. Tassie, U.S. Pat. No. 4,023,463, May 17, 1977; and A. R. Graham, U.S. Pat. No. 4,050,349, Sept. 27, 1977; cited in the applications noted above, are exemplary of that prior art. In general, the references cited show differential pressure piston devices for forcing liquid propellant from a reservoir chamber into a combustion chamber to constitute a regenerative system.

Two specific items of prior art not previously referred to deserve particular mention. U.S. Pat. No. 4,033,224 to J. W. Holtrop, July 5, 1977 (assigned to the U.S. Government), discloses a receiver for a rapid fire bolt action bulk or batch-loaded liquid propellant gun in which the structure constituting the load injection pump and the propellant control valve physically resemble the coaxial pistons according to one or more of the implementations of the invention disclosed and claimed in this specification. Similarity, however, is limited to physical resemblances of those parts as Holtrop's gun is a batch-loaded rather than a regenerative liquid propellant gun and does not address the question of pressure control during firing. The Patent of V. W. Jaqua, U.S. Pat. No. 4,281,582 issued Aug. 4, 1981, discloses a regenerative hypergolic, i.e., a two component liquid propellant having a fuel and an oxidizer, using a differential area injection piston to inject the hypergolic propellant into a combustion chamber. Jacqua also biases the injection piston hydraulically by means of a circumferential raised portion on the piston rod of the injection piston which acts as a second differential area piston. Therefore, to the extent that the Jacqua Application constitutes a complete disclosure, it teaches the use of hydraulic pressure to provide a "snubbing" (sic) effect to assist in control of movement of the injection piston in a regenerative liquid propellant gun.

SUMMARY OF THE INVENTION

This invention pertains to novel breech, receiver and combustion chamber structures for liquid propellant guns utilizing differential area pistons to provide continued or regenerative injection of a liquid propellant into the combustion chamber during the combustion portion of the cycle. More particularly, this invention pertains to guns in which a plurality of coaxial pistons are used to control the amount of charge, rate of injection of a liquid propellant, movement of a reaction member, burning rate, pressure rise and pressure variations of the combustion gases during the firing cycle.

Regenerative injection of liquid propellants (i.e., the injection of the propellant into a combustion chamber using forces generated by the combustion itself during the combustion phase) provides inherent advantages over batch-loaded systems (i.e., insertion of a discrete quantity of liquid propellant into the gun chamber during a loading phase which is completed prior to ignition) with respect to making allowance for variants, for example, different projectile weights, desired velocity, maximum pressures, etc., in predetermining pressure curves in the combustion chamber. An ultimate objective in the art is the design of a regenerative liquid propellant gun which would have flexibility based on controlled variable injection rates to accommodate changes from, for example, a relatively heavy high explosive projectile fired at a moderate muzzle velocity to, for example, a lighter sub-caliber rod penetrator projectile which is sabot launched at an extremely high muzzle velocity. An intermediate objective, as addressed by this invention, is the obtaining of technology, technique and structures which permit the design of individual guns to fulfill different missions. This is accomplished through structures for regenerative injection of a liquid propellant which permit the time rate control of propellant injection to produce a predetermined pressure relationship to time ("pt curve") to produce, in turn, a desired ballistic result. Factors to be considered include burning rate and flash point of the propellant, heat dissipation, chamber pressure required to start and maintain regenerative injection, ullage (which in this art means air space or bubbles in the reservoir more than leakage from a reservoir as the term is used in viniculture), initial chamber volume, rate of chamber expansion, etc. One specific example involves the possibility that the injection rate needed to maintain high pressure during projectile travel through the barrel could, if occurring initially, cause a flameout by heat absorption or result in an accumulation of unburned propellant in the combustion chamber. Accordingly, an objective is to obtain an injection rate which can be started by a primer or an initial amount of propellant burned by an igniter. Thereafter, the rate can be increased, beginning at a slow rate to generate a moderate pressure to stabilize the system and permit distribution of heat generated adiabatically in the ullage so as to avoid secondary ignition in the fuel supply and, thereafter, be increased more rapidly to a desired higher pressure within safety limits to be maintained for the remainder of the combustion phase.

Coaxial pistons are used in this invention to divide the breech chamber into a plurality of variable volumes wherein one volume constitutes a combustion chamber in which the propellant is burned to generate combustion gases and wherein at least one other volume contains the supply of liquid propellant to be injected into the combustion chamber during each firing. Piston surfaces define differential pressure areas and pistons contain passageways interconnecting the volumes so that combustion pressure places a compressing force on the liquid propellant to produce an injection pressure which is higher than the combustion pressure so that the propellant can be forced from the reservoir volume to the combustion chamber by movement of one or more pistons. The pistons are also arranged so that relative movement between pistons open and close some or all of the propellant passageways during firing to meter and control propellant flow. The coaxial arrangement of pistons also permits the insertion of a projectile through the breech structure to the barrel by removal of one or more pistons. Variants of the invention provide for one or more additional variable volumes defined by one or more surfaces of piston or breech structures to constitute a reservoir for an inert fluid which can be used both to regulate the quantity of the liquid propellant used for a single firing or to hydraulically control movement of one or more piston structures in positioning of elements during loading or in reaction to firing or both. Hydraulic control of a smaller or pilot piston to control flow rates and, therefore, movement of a larger piston effects an amplification and permits control of the system by means of small flow rates.

The structure as disclosed is qualitative in the sense that explicit dimensions of pistons, volumes, conduits, for a particular gun are not critical to the invention and are not provided but it is quantitative or definitive in the sense that only detailed engineering effort to quantify the concepts is necessary to apply any of the configurations shown to a particular ballistic problem. The size and numbers of orifices, holes and conduits to provide the appropriate flows at any particular time and in accordance with the propellant viscosity and burn rate and other factors to obtain the desired p.t. curve can be determined by analytical or empirical techniques.

The generic form of the invention contemplates a gun structure for using a liquid monopropellant in which the breech contains a breech bore running from the base of the barrel in extension of the barrel bore to or towards the rear of the breech with an enlarged portion of the breech bore defining a chamber extending from the base of the barrel for some distance toward the rear of the breech. In versions providing for breech loading of projectiles, the breech bore itself must have a diameter larger than the barrel bore. A differential area pressure or pumping piston having a base or shank portion journaled in the bore in the breech and an enlarged head or flange portion chambered in the enlarged bore portion defining the chamber divides the chamber into a combustion chamber volume located between the piston flange and the barrel end of the breech and a reservoir volume defined by the base and flange portions of the piston and the breech structure. An axial bore in the pressure piston which, in breech loading implementations, is large enough to permit passage of a projectile on loading, receives a removable inner piston which among other things valves passageways in the pressure piston extending between the reservoir volume and the combustion volume responsive to relative movement between the pumping and inner pistons.

DESCRIPTION OF THE INVENTION

Figure 1:
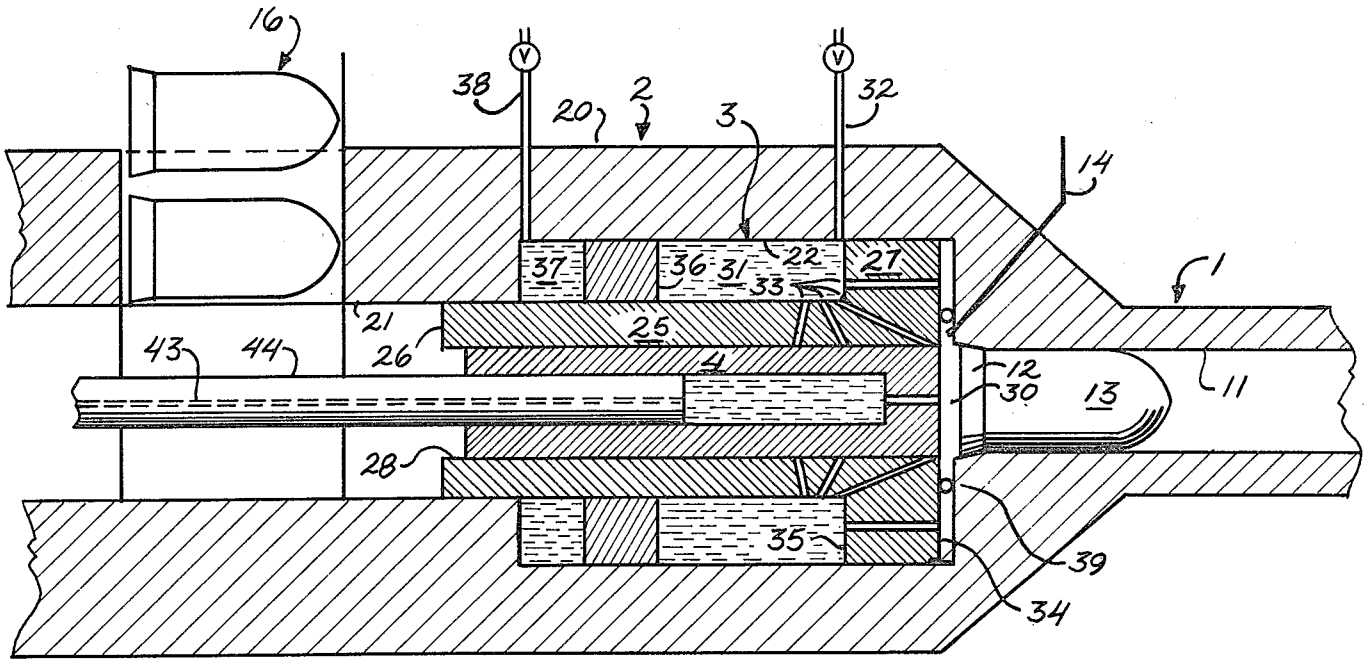
FIG. 1 is a longitudinal sectional view of one implementation of a regenerative liquid propellant gun in accordance with this invention wherein the pressure piston and pilot piston are in ready for firing positions.
Figure 2:
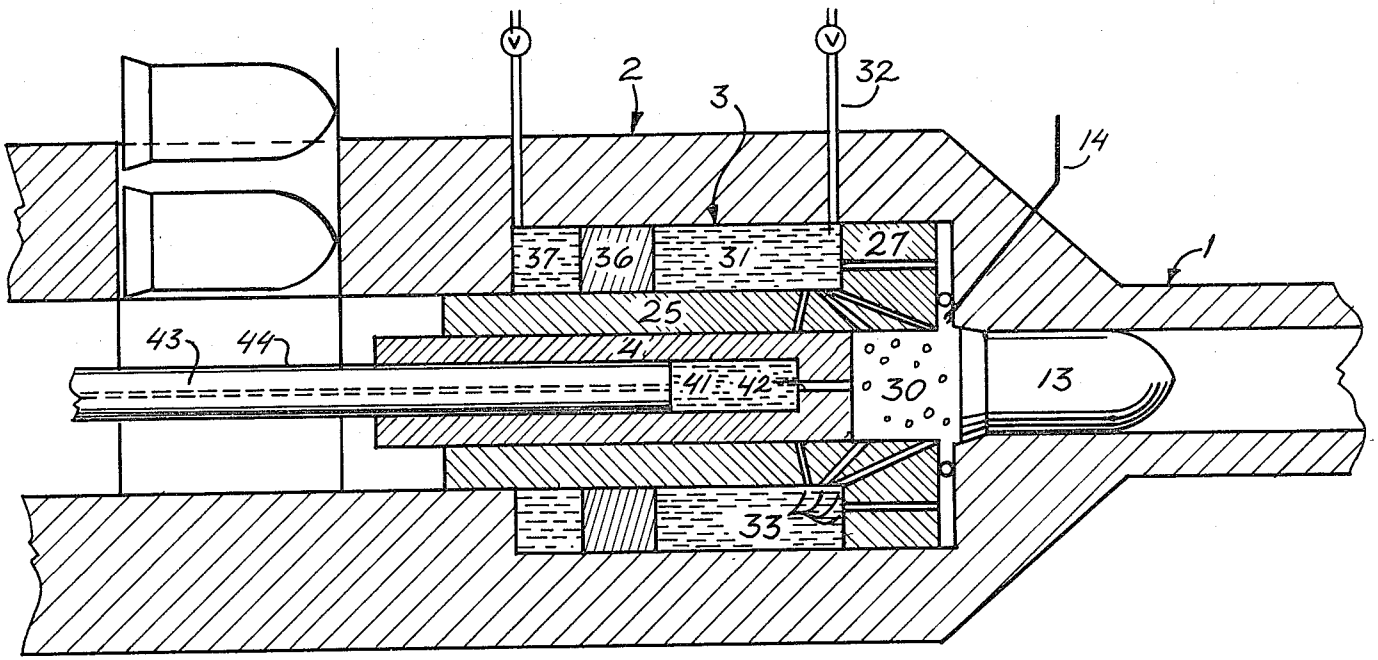
FIG. 2 is a longitudinal section of the same implementation of the invention as that of FIG. 1 wherein the components are shown in positions attained shortly after ignition.
Figure 3:
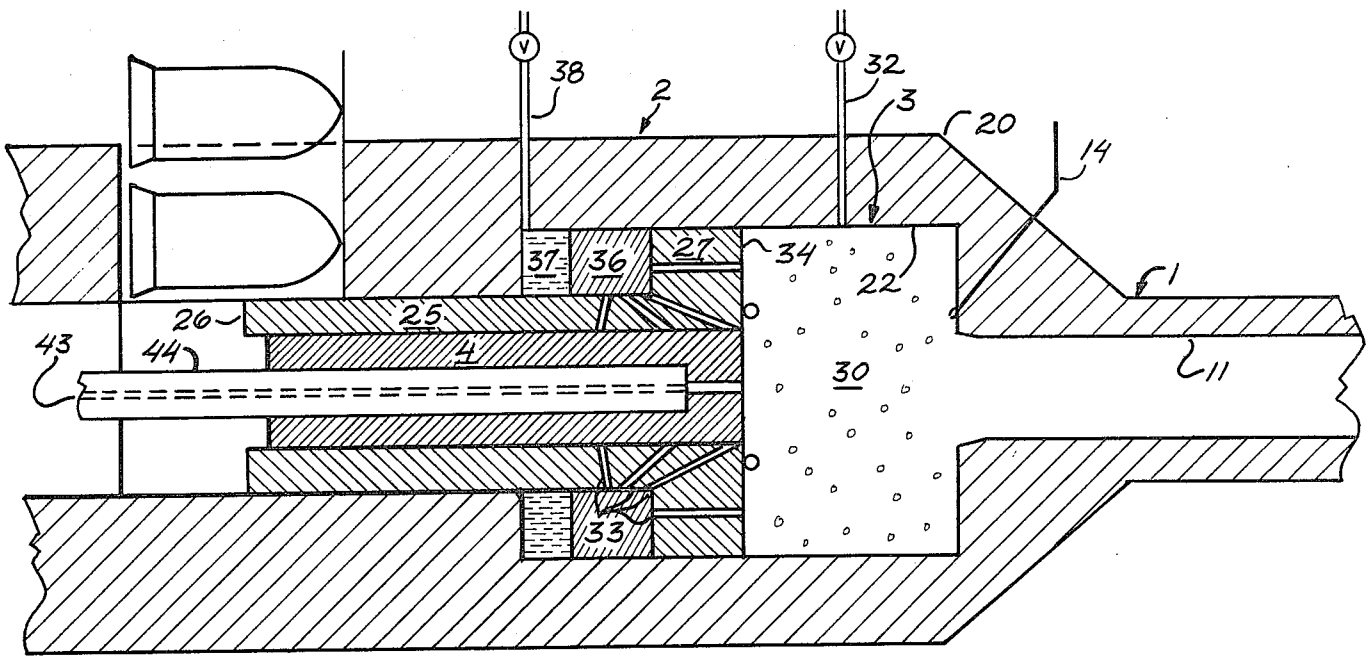
FIG. 3 is a longitudinal section of the same implementation of the invention as that of FIG. 1 wherein the components are shown in their positions at completion of the combustion phase.

A basic implementation of the chamber section of a gun according to the invention is shown in longitudinal section in FIGS. 1, 2 and 3 of the Drawings and includes a gun barrel 1, a breech mechanism 2, and a projectile feed mechanism 16 although the breech mechanism forming the invention is not dependent on, but rather provides the potential for peculiar cooperation with, a projectile feed mechanism. The barrel bore 11 which may be rifled or smooth opens into the breech mechanism and may, depending on the configuration of the gun, have a radius deviation to accept an enlarged rotating band or other projectile land-engaging area as, for example, the portion 12 on projectile 13. The breech mechanism includes: a breech casing 20 with an interior bore or receiver 21 of one diameter and an enlarged diameter partial bore or cylinder 22 which with its end walls defines a chamber 3. The operating portion of the breech includes a plurality of pistons in which one, designated with the reference number 25, is a hollow T-shaped piston having a stem, shank, shaft or skirt portion 26 journaled in bore 21 and a head or flange portion 27 extending outwardly from the shaft portion with its circumferential surface journaled in the enlarged bore 22 for a reciprocal motion along a projection of the barrel axis within the limits of chamber 3. The axial bore 28 of the hollow piston 25, in rear loading configurations, has a diameter large enough to permit passage of the projectile 13 through the breech mechanism to the barrel and receives a second or inner piston 4 journaled in that bore for motion along the barrel axis relative to piston 25. In implementations other than rear loading, for example, those having a breakaway connection between barrel and receiver, the diameter of the inner piston can be determined entirely from other parameters and the rear of the breech may be closed.

Hollow piston 25 divides the entire chamber into two separate volumes 30 and 31 of which 30 is the combustion chamber and volume 31 is a reservoir for the liquid propellant which is inserted through a valved supply system conduit 32 and has a passage or a plurality of passages 33 for the flow of propellant from reservoir 31 to the combustion chamber 30. Hollow piston 25 constitutes a differential area piston because the two surfaces 34 and 35 of the flange portion 27 are of different areas with the area of surface 34 on the combustion chamber 30 side of the head being the larger. During firing with the reservoir 31 containing the liquid propellant, the rise in pressure in combustion chamber 30 as a result of burning of the propellant within chamber 30 will force hollow piston 25 to retreat, enlarging the combustion chamber by forcing liquid propellant through one or more passages 33 into the combustion chamber to continue to fuel the burning process.

Chamber 3 in the implementation illustrated in FIGS. 1 and 2 is further subdivided by optional free piston 36 to define an additional variable volume annular reservoir 37 which is connected to a valved hydraulic system 38 for the introduction of hydraulic fluid into the reservoir 37 to permit control of the volume of reservoir 31 and, therefore, to permit selection of the exact quantity of liquid propellant used for a single firing. Although liquid propellant might be used as the hydraulic fluid for reservoir 37, an inert fluid, for example water, would provide a safety factor.

In the implementation of the invention illustrated in FIGS. 1, 2 and 3, inner piston 4 journaled in bore 28 of hollow piston 25 is also a hollow differential area piston containing a secondary or an interior reservoir chamber 41 as a dispenser for a discrete quantity of liquid propellant to assist in control of pressure buildup and to act as a pilot piston. Reservoir 41, which is defined by the space between piston 4 which is journaled on shaft 44 and the shaft, is connected to the combustion chamber 30 by means of one or more conduits 42 permitting the propellant in 41 to be injected into 30 in response to pressure generated by a primer to provide an initial charge to attain an initial, controlled buildup of pressure in the combustion chamber to activate the main differential pressure piston 25 with a predetermined time sequence. Pilot reservoir 41 is filled, for example, by means of passageway or conduit 43 running axially through shaft 44. Shaft 44 which serves to limit movement of piston 4 can be fixed by an engaging means, not shown, during the combustion phase of the firing cycle or could be made movable and controlled to produce a programmed action to provide an additional means to vary and control the movement and velocity of piston 4 as a means to control injection of propellant into the combustion chamber 30. In addition, shaft 44 can be used to insert and withdraw pilot piston 4 from hollow piston 25, by means of hydraulic pressures or by means of engaging means not illustrated, to facilitate and assist in the insertion of projectiles 13 through piston 25.

The conduit or conduits 33 illustrated in FIGS. 1–3 run between the propellant reservoir 31 and either or both of forward face 34 of flange 27 of the pumping piston or between reservoir 31 and bore 28 for the purpose of feeding the liquid propellant to the combustion chamber 30 during the combustion phase of the firing cycle. Initially, with the components of this model in the position illustrated in FIG. 1, most or all of the conduits 33 are closed off by pilot piston 4. One or more conduits 33 could, as illustrated, feed directly through face 34 to the collapsed combustion chamber 30 and, if so, be sealed off by some means, such as the leak seal 39. With the gun loaded and with the components as located in the FIG. 1 wherein reservoirs 31 and 41 are both charged with propellant and with reservoir 37 filled to place floating piston 36 as desired, there may be a slight leakage of propellant into the combustion chamber 30 through conduit or conduits 42 or from any unblocked conduit 33 which can provide a part of the ignition fuel. Leakage can be precluded, if necessary, or limited by coordinating the size and shapes of cross sections of the conduits 42 with the viscosity of the propellant to obtain a favorable capillary action or by use of check valves requiring a predetermined pressure to open. Activation of ignitor 14 will cause any small quantity of propellant present or propellant otherwise inserted for ignition to start to burn, pressurizing that portion of the combustion chamber immediately behind projectile 13. As the pressure in combustion chamber 30 increases, the differential pressure pilot piston 4 will exert pressure on the fluid in reservoir 41, causing that propellant to be forced through conduit or conduits 42 to burn in the combustion chamber. The increased pressure developed from this initial charge of propellant or a part of the charge in 41 will build the pressure to the point that piston 25 will also be forced back from chamber 30, permitting any conduit 33 which becomes uncovered by rearward movement of piston 4 or by a conduit 33 feeding through the forward face 34 of the piston 25 to feed combustion. As pilot piston 4 continues to be driven rearwardly, other conduits 33 become exposed increasing the flow rate between reservoir 31 and combustion chamber 30. The conduit or conduits 33 are so located to regulate the rate of flow of propellant into the combustion chamber as a result of the opening and closing of conduits 33 by relative movements of the two pistons and, therefore, to regulate the profile of the combustion pressure curve. The sequential closing of conduits or injection ducts 33 can also be effected by spacing the intake apertures on the reservoir side of piston 25 so that those intake apertures overrun the spacer member or piston 36 or the rear shoulder of chamber 3 serially to reduce flow of propellant more gradually. The same technique could be used, i.e., cutting off flow from the reservoir side first to let the injection ducts be drained of propellant to avoid subsequent spontaneous combustion or ignition from a hot spot. The location and size of ducts 33 can be determined empirically or calculated, taking into account the increase of the volume of combustion chamber 30 resulting not only from movement of pistons 25 and 4 rearwardly but also from movement of the projectile through the barrel. The object, of course, is to obtain the calculated pressure rise and duration curve to effect the desired ballistics without having an excess of liquid propellant to burn after the projectile leaves the barrel or to have too high a flow rate that could produce a pressure greater than the desired or safety limit of the structure or a flow rate so high as to cause a potential for flameout, particularly during the early portion of the firing cycle.

As inferred above, the amount of propellant in reservoir 31 is regulated by location of floating piston 36 which is controlled by the volume of inert fluid placed in reservoir 37 or which could be controlled by a mechanical structure as, for example, by a ratchet or threaded connection with breech casing 20 whether or not the floating piston 36 is positioned hydraulically.

On completion of the firing, the components are left in the position as illustrated in FIG. 3. Reloading can be accomplished by means of the insertion of inert fluid through system 38 to expand reservoir 37 to drive hollow piston 25 to close the combustion chamber 30 to its minimum volume while simultaneously withdrawing shaft 44 and the pilot piston 4 to permit the insertion of a new projectile. Floating piston 36 serves to prevent the inert fluid from entering injection ducts 33. With a new projectile inserted into the barrel, assisted, if appropriate, by the use of shaft 44 and pilot piston 4 as a rammer, and with piston 4 in place, liquid propellant can be inserted through systems 32 and conduit 43. By coordinating the pressure under which propellant is inserted through system 32 with the pressure on the inert fluid in system 38, assuming, of course, that pilot piston 4 is in its forward position, floating piston 36 can be driven backwards to permit the expansion of reservoir 31 to its desired capacity.

Figure 4:
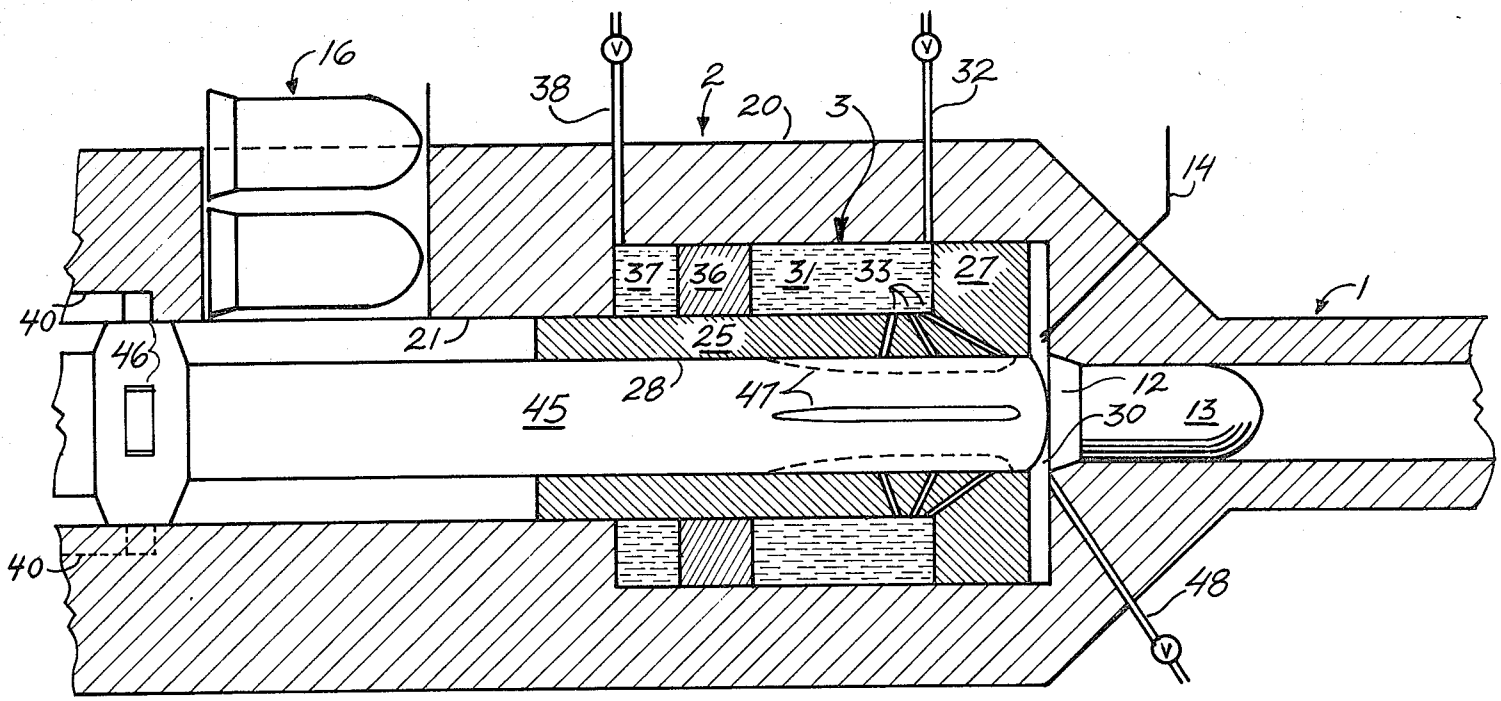
FIG. 4 is a longitudinal sectional view of a modification of the regenerative liquid propellant gun structure shown in FIGS. 1–3 in which the inner piston is keyed to the breech structure and does not move during the combustion phase.

The implementation of the invention illustrated in FIG. 4 follows the same basic organization of FIGS. 1–3 using a differential area hollow piston 25 having a flange portion 27 dividing chamber 3 into a liquid propellant reservoir 31 and a combustion chamber 30 and having an axial bore 28 in which is journaled an inner axial piston 45 to permit controlled relative movement between the hollow piston 25 and the inner piston 45 to regulate the flow of the propellant from the reservoir to the combustion chamber. In the FIG. 4 species, however, the inner piston 45 is a solid piston secured in the position shown during firing by means for locking the piston in place as, for example, lugs 46 locking the piston to the breech casing. The piston 45 is provided with feed or diffuser slots 47 which register with ducts 33 in the pumping cylinder 25 to channel the liquid propellant to spaced predetermined injection points to provide a controlled distribution of the liquid propellant in the combustion chamber 30. Propellant flow can be controlled by width, depth, length, shape and orientation of the slots 47 and the forward end of slots 47 can be shaped so as to break up the flow of the propellant into a spray of any desired configuration to facilitate rapid and even burning. Although in this species of the invention the inner piston 45 is held stationary with respect to the breech mechanism during firing, it is still the relative motion between pistons 25 and 45 which serves to regulate the flow of the propellant as it flows through conduits 33 and slots 47 to produce the desired pressure rise and duration curve. In this implementation, it may be desirable to use a primer charge inserted as, for example, through another valved conduit such as 48. The lugs 46 lock the piston 45 in place by fitting into grooves 40 in the breech casing which are shaped so that the piston 45 can be turned and withdrawn to permit loading of projectiles. In other respects as, for example, the loading procedure and positioning of the free piston 36, the mechanism of FIG. 4 operates in the same manner as that of FIG. 1.

Figure 5:
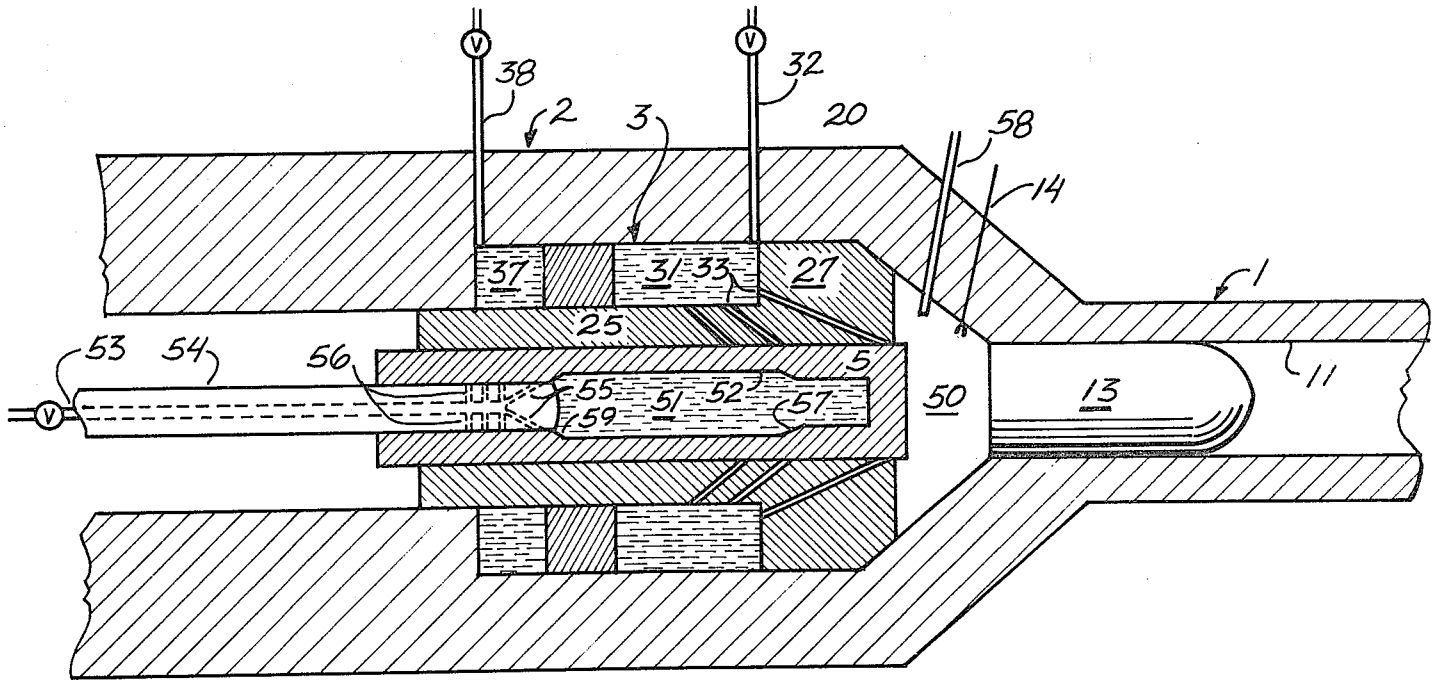
FIG. 5 is a longitudinal sectional view of a still further modification of the regenerative liquid propellant gun structure shown in FIGS. 1–3 in which the inner piston operates hydraulically to regulate flow of propellant to the combustion chamber.

Another species of the invention is illustrated in FIG. 5 wherein the inner piston assembly includes a piston 5 which is very similar to the piston 4 of the breech structure illustrated in FIG. 1 but differs in specific aspects including the fact that there is no conduit between chamber 51 and combustion chamber 50, the enlarged portion of the chamber at 52 between and defining shoulders 57 and 59 and the fact that chamber 51 is used as a reservoir for a fluid to effect control of movement of piston 5 by hydraulic pressure during firing, rather than for an initial charge as used in FIG. 1. Piston 5 receives a shaft 54 which is similar to the shaft 44 of the FIG. 1 version in that there is a central passageway or conduit 53 for the purpose of supplying a fluid to the chamber 51. In addition, in the FIG. 5 modification of inner piston assembly, the valved conduit 53 terminates in a plurality of branch passages terminating in outlets 55 and 56 which are so sized and located with respect to the enlarged chamber portion 52 and shoulders 57, 59 as to cooperate to assist in controlling and varying the rate of flow of fluid from chamber 51 out through conduit 53 responsive to pressure. Although piston 5 as illustrated is inherently a differential area piston, that characteristic is not necessary for a hydraulic system of this type unless it were designed to work against a predetermined head. In FIG. 5, the combustion chamber 50 is of slightly different size and shape than chamber 30 of FIG. 1 solely to illustrate the principle that such variations are possible, arbitrarily or as means to affect ballistic results without departing from the concepts of the invention. In the FIG. 5 arrangement, with all of the propellant conduits 33 initially interdicted by piston 5, a system for insertion of a primer quantity of liquid propellant may be advisable. Such a system is represented by conduit 58 and could be combined with the igniter system 14.

As combustion starts in combustion chamber 50, with the valve in 53 set to a predetermined opening, inner hollow piston 5 is pushed slowly to the rear by pressures resulting from the combustion as fluid from chamber 51 escapes through conduits 55 and conduit 53 at a rate determined by capacity of conduits 55. As one or more of the multiple injection ducts 33 are progressively opened, the increased quantity of flow of liquid propellant from reservoir 31 to the combustion chamber progressively increases the combustion pressure. As conduits 56 become exposed to the enlarged portion 52 of chamber 51, the rate of flow of inert fluid increases up to the limit of the setting of valve in conduit 53 permitting piston 5 to increase its rearward speed uncovering additional conduits 33. As the pressure continues to build in the combustion chamber 50, hollow piston 25 is forced to the rear increasing the pressure on and feeding liquid propellant into combustion chamber 50 at the maximum rate permitted by the conduits 33 that have been uncovered. As the pistons approach their rearward position, piston 5 is slowed somewhat as a result of the dashpot-like action of outlets 55, the entry of the end of shaft 54 into the constricted end of chamber 51 and ultimately some of the outlets 56 being interdicted by the cooperating shoulder portions 57 of the walls defining chamber 51. This causes one or more of conduits 33 to overtake and be interdicted by the front end of piston 5 as hollow piston 25 approaches its rear most position. This arrangement permits the additional shaping of the combustion chamber pressure curve by selection of sizes and locations of the conduits 33, 53, 55 and 56. Further changes can be made by varying the size and configuration of the combustion chamber 50 itself or reservoir 31 and by manipulation of the valve in 53. It should be further pointed out that the valve in conduit 53 could also be used as a control element during the combustion cycle, either on a programmed basis or as a feedback element responsive to some measured parameter such as, for example, chamber pressure to achieve finer control or closed loop control.

Surface 52 can also be contoured to vary the effective orifice area profile of orifices 55 and 56. If it is desired to change the injection profile, it could be accomplished, for example, by having several differently contoured slots in surface 52 and arranging several alternate rows of orifices 55, 56 in axial rows so that a different contour could be selected by turning one or more rows of orifices 55, 56 to the desired contoured slot. This could allow for a change from one projectile to another having a different mass or requiring a different pressure/time curve to achieve the desired ballistic performance. For such arrangement, of course, keys and keyways would be necessary to prevent random rotation of the piston 5 with respect to shaft 54.

Figure 6:
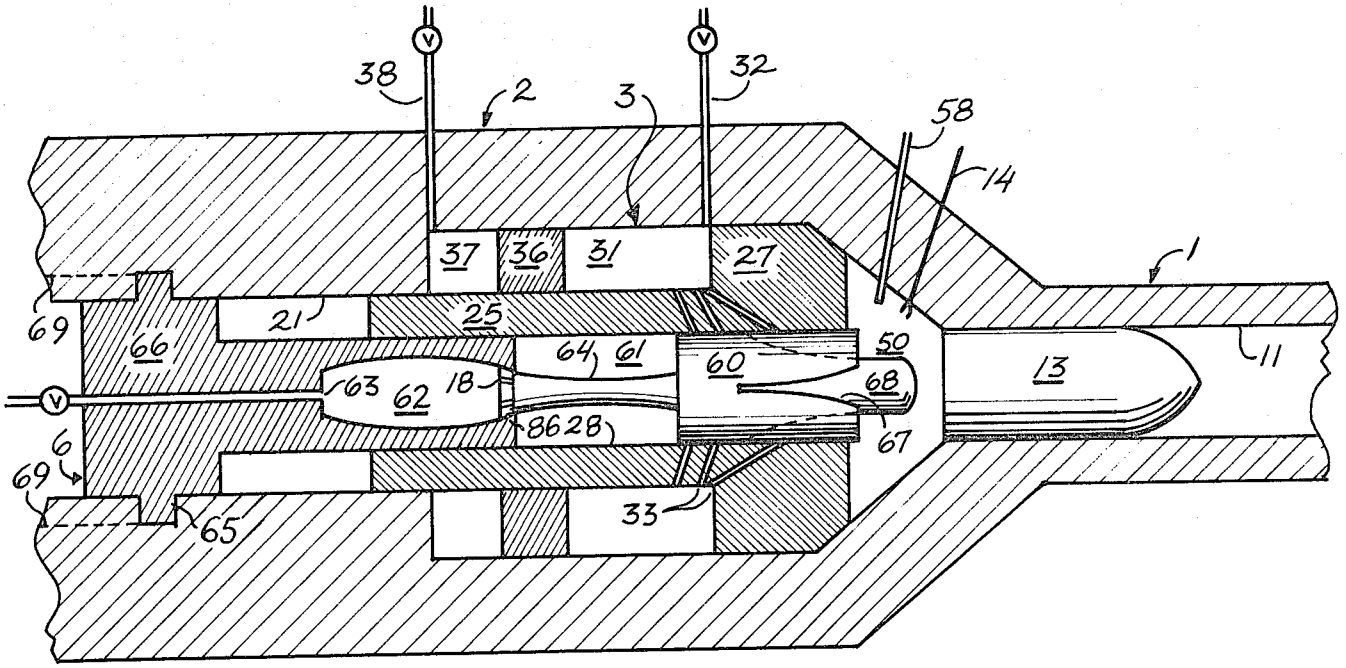
FIG. 6 is a longitudinal sectional view of another implementation of the regenerative liquid propellant gun having a compound inner piston for control of propellant burning rate.

A further species of the invention is illustrated in FIG. 6 wherein the inner piston assembly 6 combines characteristics of the assemblies of pistons 45 and 5 of the implementations of the invention illustrated in FIGS. 4 and 5 respectively. Inner piston assembly 6 consists of two pieces, a pilot piston or forward portion 60 which moves during the combustion cycle relative to a base or bolt portion 66 which is locked to the breech casing 20 by means of lugs 65 fitting into key slots 69 during combustion. The bolt portion 66 has a passageway or conduit 63 running from a valved system into an enlarged bore portion constituting a reservoir 62. The pilot piston 60 itself is journaled into central bore 28 of the differential pressure pumping piston 25 and includes a main cylindrical portion 60 and a stem portion 64 which terminates remotely from the cylindrical portion in a band portion 18 fitted within the constricted forward end of the shaped bore 62 in the bolt portion of the inner piston 6 which serves to limit forward movement of portion 60. The band portion 18 acts as a plunger valve to vary fluid flow and is slotted or otherwise relieved to permit a minimum rate of passage of fluid. When pilot piston 60 is in the position shown in FIG. 6 which is in its forward ready-for-firing position, it is spaced from the forward end of bolt 66 and defines with longitudinal bore 28 of piston 25 and the forward surface of bolt 66, a reservoir 61. This portion, i.e., floating piston 60, stem 64, band 18, reservoirs 61 and 62, and conduit 63, constitutes a hydraulic system for the controlled rearward movement of floating piston 60 under the force of combustion pressure in a manner similar to the action of inner piston 5, reservoir 51, and the conduits in stem 54 in the implementation of the invention illustrated in FIG. 5. The differential area piston characteristics of piston 60, which similar to piston 5 of FIG. 5 is not a requirement for systems not injecting fluid into the combustion chamber, can also be changed by varying the mass of piston 60, the thickness of the stem 64 and diameters of band 18 and reservoir 62. The cylindrical main portion of pilot piston 60 also contains cutaway portions or slots 67 spaced to register with and receive liquid propellant from conduits 33 in pressure piston 25 during the firing cycle. In addition, the surfaces defining the bottoms of slots 67 sweep down and forward to form the surface of the nose 68 which is contoured to facilitate dispersion of liquid propellant fed to the combustion chamber from conduits 33. The burning of a primer quantity of liquid propellant introduced through the primer feed 58 when ignited by igniter 14 creates pressure to force pilot piston 60 rearwardly displacing the liquid content of reservoir 61, which is normally an inert fluid under pressure, so as to force that fluid back through reservoir 62 and valved conduit system 63. The resulting movement of piston 60 uncovers additional conduits 33 to increase flow of propellant from reservoir 31 to the combustion chamber. The additional flow of propellant creates additional pressure on the forward surface of flange 27 of the pumping piston 25 which in turn increases the rate of flow of the liquid propellant through the conduits 33. From this, it is readily understood that flow of propellant through conduits 33 is a function of the chamber pressure and the relative movements of pistons 25 and 60 which determines the flow capacity of conduits 33. The other factor involved is the hydraulic bias on piston 60 created by controls and restrictions built into the hydraulic system. As indicated in FIG. 6, the valve in conduit 63 determines an absolute maximum flow rate of fluid from reservoir 61 for any given pressure. Within this maximum, however, flow rate can be further controlled by the use of a variable or programmed valve as already described with reference to the implementation of FIG. 5 or by the interaction of stem 64, band 18 and the shape of the walls of reservoir 62. As illustrated, the fit between band 18 and the reduced mouth portion of reservoir 62 at shoulder 86 restricts the flow of fluid initially to the capacity of the grooves on band 18. This flow capacity then increases as band 18 approaches the wider portion of reservoir 62 where the flow may or may not be limited to that determined by the valve in conduit 63, depending on the setting at the time. As piston 60 approaches the limit of its travel, band 18 in cooperation with the base shoulder again restricts hydraulic flow and could be designed as a dashpot or could have an additional band surface to interact with a valve seat at 63. Flow control can also be effected by the relationship of the contour of stem 64 to the mouth of the smaller reservoir 62 at 86 by shaping the stem 64 to define the area of the annulus through which fluid can flow for any position of piston 60. A profile of stem 64 as illustrated would provide resistance to flow at each end of the stroke but other configurations are possible. Accordingly, the size and shape of slots 67, band 18 and its grooves, shoulders 86 and the valve in conduit 63 as well as the location and size of conduits 33 constitute parameters which can be used to effect control of pt curves in the implementation of FIG. 6.

Figure 7:
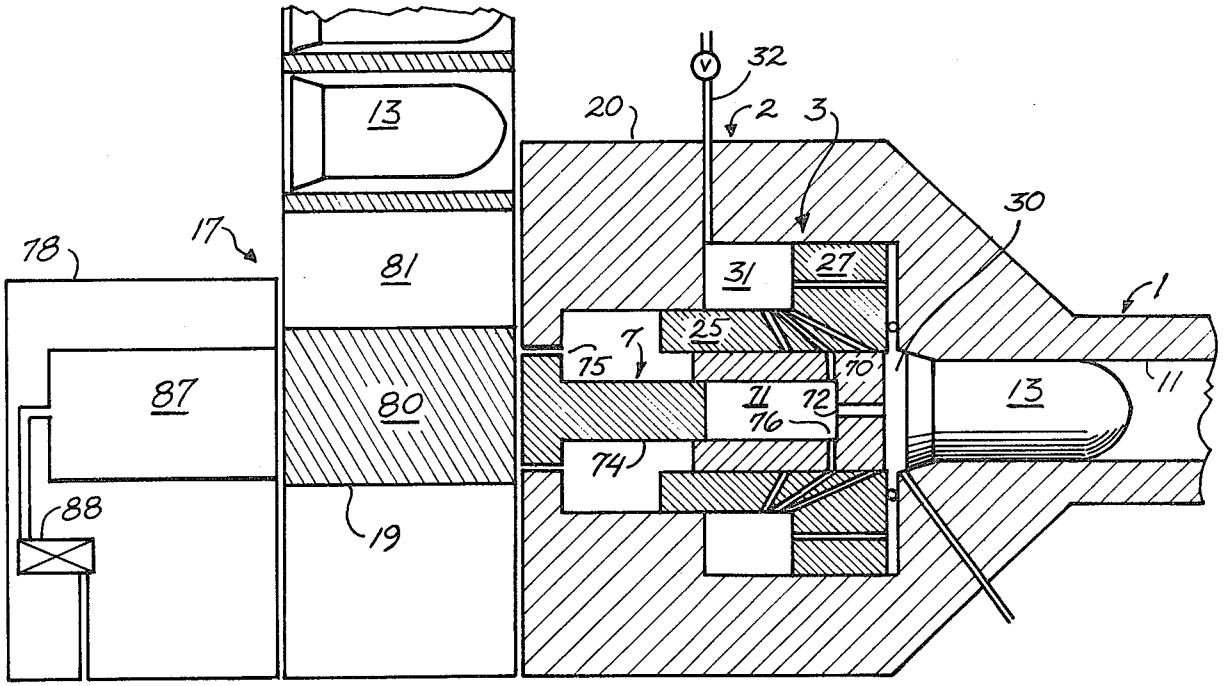
FIG. 7 is a longitudinal sectional view of still another implementation of the invention which also includes a schematic illustration of a projectile loading system.

A further species of the invention illustrated in FIG. 7 is a modification of the version illustrated in FIG. 1 incorporating a modified inner piston to particularly accommodate a specific loader concept. In this version, the liquid propellant feeding system is simplified and compacted. The inner piston 7 includes a pilot piston 70 which has a hollow bore reservoir portion 71 into which is journaled stem portion 74 protruding from the base portion 75 of the inner piston. In this version, a conduit or conduits 72 interconnects the reservoir 71 and the combustion chamber 30 so that the reservoir may be used as a pilot reservoir which is loaded by means of a set of registering through holes forming conduit 76. This configuration is particularly adaptable to the loading system 17 which includes a reciprocating breech block and projectile rack device 19 and loading drive mechanism 78. The breech block and projectile rack unit 19 includes a breech block 80 and a plurality of cylindrical chambers 81, each of which can contain a projectile 13 or can receive inner piston 7 in its entirety. The loading drive mechanism 78 includes a cylindrical chamber 87 and a pneumatic system 88, or another device such as a chain drive, for movement of inner piston 7 into and out of a cylindrical chamber 87.

In the FIG. 7 device, the combustion pressures operate pilot piston 70 and pressure piston 25 in the same way as the operation of the FIG. 1 device, with the difference that floating piston 70 in its position of extreme travel forms with base portion 75 a compact cylindrical mass 7 which can be moved through a projectile rack cylinder 81 of the breech block and projectile rack device 19 into cylindrical chamber 87 in the loading drive mechanism 78. With inner piston 7 located within cylindrical chamber 87, the breech block and projectile rack device 19 can be moved to register another chamber 81 containing a projectile with the axis of the gun and the loading drive mechanism actuated to cause inner cylinder 7 to act as a rammer to move a projectile 13 into the barrel bore.

It will be noted that the illustrations in FIGS. 1 through 7 are schematic in that they do not include details of O-rings, seals and threaded connections of parts which would be necessary for efficient manufacture and operation. It is believed that these details are routine engineering which, if illustrated and explained, would serve principally only to obscure the concepts involved. For example, it is common practice in the art and contemplated by the inventor that the barrel 11 and the breech casing 20 can constitute one or more pieces connected together by one or more screw, interrupted screw, or other suitable interconnections which would also facilitate assembly of the device by permitting the insertion of hollow pressure piston 25 into chamber 3 during assembly. Further, it is common practice to use sealing devices such as grooves and O-rings in the cylindrical surfaces of the various pistons to preclude leakage of various fluids used from the particular chambers in which they are located.

Although five different embodiments or implementations of the invention are illustrated and described, they all constitute variants of the same concept of use of relative motion between coaxial pistons to effect propellant valving in combination with other parameters which can be changed in a direct injection regenerative liquid propellant gun structure to permit preprogramming of both the quantity and flow rate of propellant to produce the desired time growth and duration of pressure in the chamber. It is contemplated that details, or for that matter the particular features of the several embodiments, would be selected evaluated and established for any specific application without departure from the scope of the invention. In addition, it must be noted that the invention is also applicable to hypergolic, i.e., bipropellant, systems on the basis of subdividing the reservoirs or adding additional injectors and that the structures disclosed are readily usable in multiple chamber arrangements, in a "revolver" configuration or, except for the breech loading capability, surrounding a breech loading mechanism for projectiles whether the axes of the liquid propellant units are parallel to the barrel axis or arranged radially.

What is claimed as new and desired to be secured by Letters Patent is:

1. In a direct injection regenerative liquid propellant gun mechanism having a breech casing with a breech bore for attachment to a gun barrel, the improvement comprising:

a. a T-shaped differential area pressure piston journaled in said breech bore for movement axially thereof with its head facing the barrel end of said casing and dividing said breech bore into a combustion chamber at the barrel end of the casing and an annular propellant reservoir surrounding its stem, (1) said pressure piston having an axial bore through its head and stem and injection ducts through its stem for conveying liquid from said reservoir to said axial bore for delivery to said combustion chamber;

b. a second piston journaled in said axial bore for axial movement relative to said pressure piston to block and unblock said injection ducts; and c. means for limiting movement of said second piston responsive to combustion pressure in said combustion chamber as predetermined to effect the desired blocking and unblocking of said injection ducts;

whereby combustion pressure acting on said differential area pressure piston will drive liquid propellant from said annular reservoir to said combustion chamber through any said ducts which are unblocked; and whereby combustion pressure can be controlled in part by controlling the relative movement between said pistons to vary the flow of propellant to said combustion chamber responsive to combustion pressure.

2. The improvement of claim 1 wherein:

a. said second piston is also a differential area piston operating between said combustion chamber and a reservoir in a hydraulic system; and b. said means for limiting movement of said second piston includes means for controlling flow of a hydraulic fluid in said hydraulic system responsive to movement of said second piston in reaction to combustion pressure.

3. The improvement of claim 1 wherein:

said second piston has an exterior surface which is shaped to channel the flow of a liquid moving from said injection ducts to said combustion chamber in a predetermined fashion.

4. The improvement of claim 3 wherein:

said means for limiting movement of said second piston is means for holding said second piston in a fixed position while said pressure piston moves in reaction to combustion pressure.

5. An improved breech structure for a direct injection regenerative liquid propellant gun comprising:

a. a coaxial piston structure including an outer piston and an inner piston assembly mounted coaxially in a breech casing having a barrel end and a breech end wherein:

(1) said outer piston is movable axially with respect to said casing, defines a variable volume combustion chamber in cooperation with the barrel end of said casing, defines a variable volume primary reservoir in cooperation with the breech end of said casing and constitutes a differential area piston between said chamber and said primary reservoir having its larger piston area exposed to said combustion chamber, (2) said outer piston has an axial bore and injection ducts for flow of liquid propellant from said primary reservoir into said bore for feeding propellant from said primary reservoir to said combustion chamber, (3) said inner piston assembly is journaled in said bore to permit relative axial displacement between said piston and said piston assembly to control said flow and the rate of said flow of propellant from said injection ducts to said combustion chamber, and (4) said inner piston assembly has a forward piston portion exposed to said combustion chamber;

b. means for supplying a quantity of liquid propellant to said primary reservoir;

c. means for initiating combustion in said combustion chamber;

whereby initiation of combustion with said piston structure in firing position and with propellant in said reservoir will cause liquid propellant to be driven from said reservoir through said injection ducts in response to combustion pressure on said piston structure; and whereby the rate of increase of pressure, the pressure attained and the duration of pressure in said combustion chamber are in part functions of the quantity and rate of flow of propellant through said injection ducts which in turn in a function of the capacity of said reservoir, the size and location of said ducts, relative movement of components of said piston structure, the rate of expansion of volume of said combustion chamber and the pressure in the combustion chamber.

6. The breech structure of claim 5 wherein:

a. said breech casing is coaxial with an attached barrel and has an opening at the breech end thereof to permit passage of said inner piston assembly and a projectile;

b. said bore in said outer piston is large enough to permit passage of a projectile through said breech through said outer piston to said barrel for loading when said inner piston assembly is not present; and c. said breech structure further comprises means for removal and insertion of said inner piston assembly and means for preventing escape of said inner piston assembly during firing;

whereby said breech structure comprises the breech mechanism for a breech loading gun.

7. The breech structure of claim 5 or claim 6 wherein:

said inner piston assembly has fluid channelling means on its exterior surface about its combustion chamber end, said channelling means being located to receive propellant from said injection ducts and dispense said propellant into said combustion chamber during at least part of the firing cycle as said outer piston is forced away from the barrel end of said breech casing during combustion;

whereby the physical form and dispersion pattern of said propellant as injected into said combustion chamber is in part a function of the size and shape of said channelling means.

8. The breech structure of claim 7 wherein:

a. said inner piston assembly is divided into two portions with complemental interface surfaces which cooperate with said bore in said outer piston to define an inner piston reservoir having a variable volume;

b. one of said two portions includes means permitting flow of a fluid to and from said inner reservoir.

9. The breech structure of claim 5 or claim 6 wherein:

a. said inner piston assembly defines an inner piston reservoir having a variable volume;

b. said forward piston portion of said inner piston assembly constitutes a piston between said combustion chamber and said inner piston reservoir;

c. said inner piston assembly further comprises means for filling said inner piston reservoir with a fluid and means for said fluid to exit said inner piston reservoir;

whereby said forward portion of said inner piston moves during firing as a function of pressure in the combustion chamber and the rate of exit of fluid from said inner piston reservoir.

10. The breech structure of claim 9 wherein:

a. said inner piston assembly is comprised of said forward piston portion and a base portion wherein:

(1) said portions are separate and have mating interface surfaces, (2) the space between said interface surfaces comprises said inner piston reservoir, and (3) said base portion has a fluid passage for flow of fluid between an external source of fluid and said inner piston reservoir comprising said means for filling said inner piston reservoir.

11. The breech structure of claim 10 wherein:

said mating interface surfaces of said forward and base portions of said inner piston include portions constituting a dashpot and plunger.

12. The breech structure of claim 9 wherein:

a. said inner piston assembly further comprises:

(1) a reaction member engaging said forward piston portion of said inner piston assembly in a manner permitting movement of one with respect to the other, and (2) means for immobilizing said reaction member to cause the volume of said inner piston reservoir to vary in response to movement of said forward piston portion of said inner piston assembly; and b. said means for filling said inner piston reservoir comprises a passageway in said reaction member for conducting fluid from outside said breech casing to said inner reservoir.

13. The breech structure of claim 12 wherein:

a. said reaction member is a rod supported within said bore in said outer piston axially thereof having one end located within the range of movement of said outer piston;

b. said means for filling and said means for fluid to exit said inner piston reservoir is a fluid passageway running the length of said rod and branch passageways debouching from said rod at a plurality of locations proximate to but at slightly different distances from said one end of said rod;

c. said forward piston portion is a hollow cylinder having an axial cavity, having one closed end constituting said piston between said combustion chamber and said inner piston reservoir and having one open end journaled on said rod at said one end of said rod; and d. said axial cavity comprises said inner piston reservoir having a central portion dimensioned to be spaced from said rod and end portions dimensioned to fit said rod;

whereby flow of fluid from said inner piston reservoir is limited at the extremes of travel of said inner piston as said branch passageways are sequentially interdicated by said end portions of said axial cavity.

14. The breech structure of claim 8 wherein:

said means for fluid to exit said inner piston reservoir comprises fluid conduit means running through said forward piston portion of said inner piston assembly to allow fluid to flow from said inner piston reservoir to said combustion chamber;

whereby said inner piston reservoir can be used as a dispenser of an initial amount of liquid propellant to be introduced to said combustion chamber prior to opening of said injection ducts.

15. The breech structure of claim 12 wherein:

a. said passageway in said reaction member also constitutes said means for fluid to exit said inner reservoir; and b. said passageway includes means for controlling the rate of flow of fluid exiting said inner piston reservoir in response to combustion pressure in said combustion chamber;

whereby said inner piston reservoir, passageway and means for controlling the rate of flow of fluid exiting said inner piston reservoir constitutes a hydraulic system limiting the rate of movement of said forward piston portion of said inner piston assembly and contributing to the control of flow of liquid propellant from said primary reservoir to said combustion chamber.

16. The breech structure of claim 15 wherein:

said means for controlling the rate of flow of fluid exiting said inner piston reservoir further comprises:

contour means on said reaction member and on said forward piston portion which cooperate to vary the flow of fluid from said inner piston reservoir to said passageway as a function of the relative position of said reaction member and said forward piston portion.

17. The breech structure of claim 15 wherein:

a. said means for controlling the rate of flow of fluid exiting said inner piston reservoir further comprises:

(1) multiple orifices for flow of fluid between said inner piston reservoir and said passageway, and (2) cooperating portions of said reaction member and said forward piston portion of said inner piston assembly for causing said multiple orifices to be blocked and unblocked sequentially responsive to the relative movement of said forward piston portion and said reaction member;

whereby said means for controlling the rate of flow of fluid exiting said inner piston reservoir produces a flow rate having a predetermined profile during the firing cycle.

18. The breech structure of claim 17 wherein:

a. said forward piston portion of said inner piston assembly has a forward position at the beginning of the firing cycle which maximizes the capacity of said inner piston reservoir and a rearward position to which it is forced by combustion pressure during the firing cycle which minimizes the capacity of said inner piston reservoir; and b. said cooperating portions of said reaction member and said forward piston portion of said inner piston assembly include portions of said forward portion cooperating with said reaction member at and proximate both said forward position and said rearward position of said forward portion of said inner piston;

whereby the flow rate of fluid exiting from said inner piston reservoir is less at the beginning and end of the travel of said inner piston that it is midway of said travel.

19. A direct injection regenerative liquid propellant gun mechanism comprising:

a. a breech casing having a barrel end and a breech end surrounding and defining a cylindrical breech bore, (1) said barrel end having a barrel bore port and means for supporting a gun barrel with its bore in communication with said barrel bore port, and (2) said cylindrical breech bore having a larger diameter portion at said barrel end and a smaller diameter portion at said breech end of said casing;

b. a cylindrical T-shaped piston journaled in said cylindrical breech bore for reciprocal motion therein with its stem portion in said smaller diameter portion and its head portion in said larger diameter portion dividing said larger portion into a combustion chamber at said barrel end of said breech casing and an annular reservoir defined by said piston and said casing, (1) said T-shaped piston having an axial bore through said head and stem portions, and (2) said stem portion also having injection ducts through said stem portion to permit flow of a liquid from said annular reservoir through said axial bore to said combustion chamber;

c. means for supplying a quantity of liquid propellant to said annular reservoir;

d. an inner piston journaled in said axial bore for relative axial movement with respect to said T-shaped piston for blocking and unblocking flow of a liquid between said annular reservoir and said combustion chamber;

e. means for limiting movement of said inner piston; and f. means for initiating combustion in said combustion chamber;

whereby pressure in said combustion chamber resulting from combustion will cause relative movement between said pistons unblocking said injection ducts and will cause said T-shaped piston to act as a differential area piston to force liquid propellant from said annular reservoir to said combustion chamber to fuel the combustion.

20. The gun mechanism of claim 19 wherein said injection ducts include ducts located at a plurality of locations axially of said T-shaped piston;

whereby said ducts are blocked and unblocked and flow rate of propellant through said ducts is changed incrementally by relative motion between said T-shaped piston and said casing and between said T-shaped piston and said inner piston.

21. The gun mechanism of claim 19 wherein:

a. said breech bore extends through the breech end of said casing;

b. said axial bore in said T-shaped piston and said inner piston are aligned with said barrel bore and are large enough to permit insertion of a projectile through said axial bore to said barrel bore when said inner piston is not present;

c. said means for limiting movement of said inner piston also includes means for removing and inserting said inner piston in said axial bore;

whereby said gun mechanism constitutes a breech loading gun mechanism.

22. The gun mechanism of claim 19 or claim 21 further comprising:

a. an annular spacer member journaled between said casing in said larger diameter portion of said breech bore and said stem portion of said T-shaped piston partitioning off a portion of said annular reservoir to form an adjustable annular volume remote from said head portion of said T-shaped piston; and b. means for supplying a quantity of fluid to said adjustable volume;

whereby the liquid propellant capacity of said annular reservoir may be reduced by insertion of a fluid into said adjustable volume to expand said volume to move said spacer member to reduce the capacity of said annular reservoir.

23. The gun mechanism of claim 19 or claim 21 wherein:

said inner piston has fluid channelling means on its exterior located so as to register with said injection ducts in said T-shaped piston to receive liquid propellant from said ducts and convey said propellant to said combustion chamber in a predetermined physical form and dispersion pattern.

24. The gun mechanism of claim 23 wherein:

a. said inner piston is rigidly connected to said casing during firing by said means for limiting movement of said inner piston; and b. said fluid channelling means includes means to cause liquid propellant to be sprayed into said combustion chamber.

25. The gun mechanism of claim 23 wherein:

a. said inner piston has a base portion attached to said means for limiting movement of said inner piston;

b. said inner piston has a forward portion separate from said base portion but connected to said base portion by interlocking means providing limited movement of said forward portion relative to said base portion to create with the walls of said axial bore a secondary reservoir having a capacity which is variable responsive to movement of said forward portion to and from said base portion;

c. said base portion includes a passageway for flow of fluid between an exterior source and said secondary reservoir; and d. said interlocking means constitutes a dashpot and means for metering flow of fluid from said secondary reservoir to said exterior source;

whereby metering of the flow of fluid from said secondary reservoir during the firing cycle contributes to control of the pressure in the combustion chamber.

26. The gun mechanism of claim 19 or claim 21 wherein:

a. said inner piston and said means for limiting movement of said inner piston include means for containing a fluid defining a secondary reservoir having a capacity that is variable responsive to relative movement between said inner piston and said means for limiting movement of said inner piston; and b. said means for limiting movement of said inner piston includes conduit means permitting flow of a fluid between an external source and said secondary reservoir;

whereby said inner piston constitutes a piston between said combustion chamber and said secondary reservoir for contracting said secondary reservoir from a maximum to a minimum capacity responsive to pressure created by combustion in said combustion chamber.

27. The gun mechanism of claim 26 wherein:

a. said inner piston further comprises at least one injection port for the passage of fluid from said secondary reservoir to said combustion chamber; and b. said inner piston is a differential area piston;

whereby said secondary reservoir constitutes an auxiliary reservoir for liquid propellant.

28. The gun mechanism of claim 26 wherein:

said means for containing a fluid, said means for limiting movement of said inner piston and said inner piston include cooperating means for varying the flow rate of a fluid into and through said conduit means in said means for limiting movement of said inner piston to effect control of movement of said inner piston when said inner piston moves to contract said secondary reservoir responsive to pressure in said combustion chamber;

whereby said secondary reservoir may be used as a hydraulic system to resist movement of said inner piston to assist in control of the rate of flow of a liquid propellant from said annular reservoir through said injection ducts to said combustion chamber.

29. The gun mechanism of claim 28 wherein:

said cooperating means for varying the flow rate of fluid includes multiple orifices for the flow of fluid between said conduit means and said secondary reservoir and means on said inner piston for blocking and unblocking said orifices responsive to movement of said inner piston.

30. The gun mechanism of claim 28 wherein:

said cooperating means for varying the flow rate of fluid includes a valve plunger and a valve body which move with respect to one another responsive to movement between said inner piston and said means for limiting movement of said inner piston.

31. The gun mechanism of claim 28 wherein:

said conduit means permitting flow of fluid between an external source and said secondary reservoir also includes an adjustable valve.

32. The gun mechanism of claim 28 wherein:

said inner piston has an exterior surface which is shaped so as to receive liquid propellant from said injection ducts and to deliver said propellant to said combustion chamber in a predetermined physical form and distribution pattern.

* * * * *